US006945320B2

(12) United States Patent
Harvard, Jr. et al.

(10) Patent No.: US 6,945,320 B2
(45) Date of Patent: Sep. 20, 2005

(54) TUBULAR HEAT EXCHANGER WITH OFFSET INTERIOR DIMPLES

(75) Inventors: Harold Gene Harvard, Jr., Terrell, TX (US); Steven Schneider, Plano, TX (US); Eric M. Perez, Lake Dallas, TX (US)

(73) Assignee: Lennox Manufacturing Inc., Richardson, TX (US)

( * ) Notice: Subject to any disclaimer, the term of this patent is extended or adjusted under 35 U.S.C. 154(b) by 0 days.

(21) Appl. No.: 10/764,666

(22) Filed: Jan. 26, 2004

(65) Prior Publication Data

US 2005/0161209 A1 Jul. 28, 2005

(51) Int. Cl.[7] ..... F28F 13/12
(52) U.S. Cl. ..... 165/109.1; 165/177; 126/110 R
(58) Field of Search ..... 165/108–184; 126/110

(56) References Cited

U.S. PATENT DOCUMENTS 1,991,788 A * 2/1935 Catter ..... 138/38
2,591,235 A * 4/1952 Cartter ..... 126/91 A
3,232,280 A * 2/1966 Loebel ..... 122/149
5,094,224 A * 3/1992 Diesch ..... 126/110 R
5,375,654 A * 12/1994 Hougland et al. ..... 165/109.1
5,839,505 A * 11/1998 Ludwig et al. ..... 165/109.1
6,289,982 B1 * 9/2001 Naji ..... 165/177
6,422,306 B1 * 7/2002 Tomlinson et al. ..... 165/170
6,453,989 B1 * 9/2002 Watanabe et al. ..... 165/177
2002/0005275 A1 * 1/2002 O'Donnell et al. ..... 165/109.1
2003/0029608 A1 * 2/2003 Shimoya ..... 165/152

* cited by examiner

*Primary Examiner*—Allen J. Flanigan
(74) *Attorney, Agent, or Firm*—W. Kirk McCord

(57) ABSTRACT

A tubular heat exchanger has at least one pair of dimples which are extruded into at least one tube of the heat exchanger by deforming the tube wall inwardly. The dimples of each pair are in generally facing relationship, but are offset with respect to each other along a longitudinal axis of the tube, which slows down the flow of flue gas in the tube when the heat exchanger is in operation and increases the turbulence of the gas, thereby enhancing the transfer of heat from the flue gas to air flowing across the outer surfaces of the heat exchanger. The offset design allows each dimple to protrude beyond the centerline of the tube, which alters the direction of the flue gas flowing in the tube.

19 Claims, 4 Drawing Sheets

TUBULAR HEAT EXCHANGER WITH OFFSET INTERIOR DIMPLES

TECHNICAL FIELD

This invention relates generally to heat exchangers used in furnaces and the like and in particular to a tubular heat exchanger having an interior structure to enhance the turbulence of combustion products flowing through the heat exchanger tubes.

BACKGROUND ART

Heat exchangers used in furnaces and other heating apparatus are typically comprised of plural metal tubes, each of which may be bent in a serpentine fashion to form multiple passes for the flue gas flowing in each tube. The inlet of each tube is in communication with a burner assembly in which a combustible fuel-air mixture is burned. The outlet of each tube is in communication, either directly or indirectly through a secondary heat exchanger, with a flue vent or the like, whereby flue gas is exhausted from the heating apparatus. The flue gas flowing in the heat exchanger tubes transfers heat to air passing over the outside of the tubes, whereby air supplied to an indoor space is heated.

It is known in the art that heat transfer efficiency may be enhanced by slowing the flow of the gaseous products of combustion in the tubes and by increasing the turbulence thereof. One approach to accomplishing both of these results is to insert one or more baffles in the tubes to break up the laminar flow of the hot gas. Another approach is to flatten the tubes at certain locations to restrict and alter the flow of the gas. Yet another approach, as described in published U.S. patent application US 2002/0005275, is to extrude opposing pairs of dimples into the tube, so that the dimples of each pair are in alignment and form a pair of adjacent converging, diverging nozzles inside the tube.

SUMMARY OF THE INVENTION

In accordance with the present invention, a tubular heat exchanger has at least one tube adapted to receive products of combustion in a furnace or other heating apparatus. The heat exchanger has at least one tube with an interior passageway and a wall surrounding the passageway. At least one pair of dimples projects from the wall into the passageway. The dimples are in generally facing relationship, but are offset from each other along a longitudinal axis of the tube.

In accordance with one embodiment of the invention, the tube has a generally circular cross-section and at least one of the dimples projects into the passageway beyond a centerline of the tube, so that at least one dimple projects inwardly by more than one-half of the diameter of the tube. In accordance with another embodiment of the invention, the dimples of each pair are offset from each other along the longitudinal axis of the tube by no more than one-half of the length of each dimple along the longitudinal axis. In accordance with yet another embodiment of the invention, both of the dimples of at least one pair of dimples project inwardly beyond the centerline of the tube. Each of the dimples is extruded into the passageway by deforming the tube wall and preferably defines a convex surface in the passageway.

BEST MODE FOR CARRYING OUT THE INVENTION

The best mode for carrying out the invention will now be described with reference to the accompanying drawings. Like parts are marked in the specification and drawings with the same respective reference numbers. In some instances, proportions may have been exaggerated in order to depict certain features of the invention.

Figure 1:
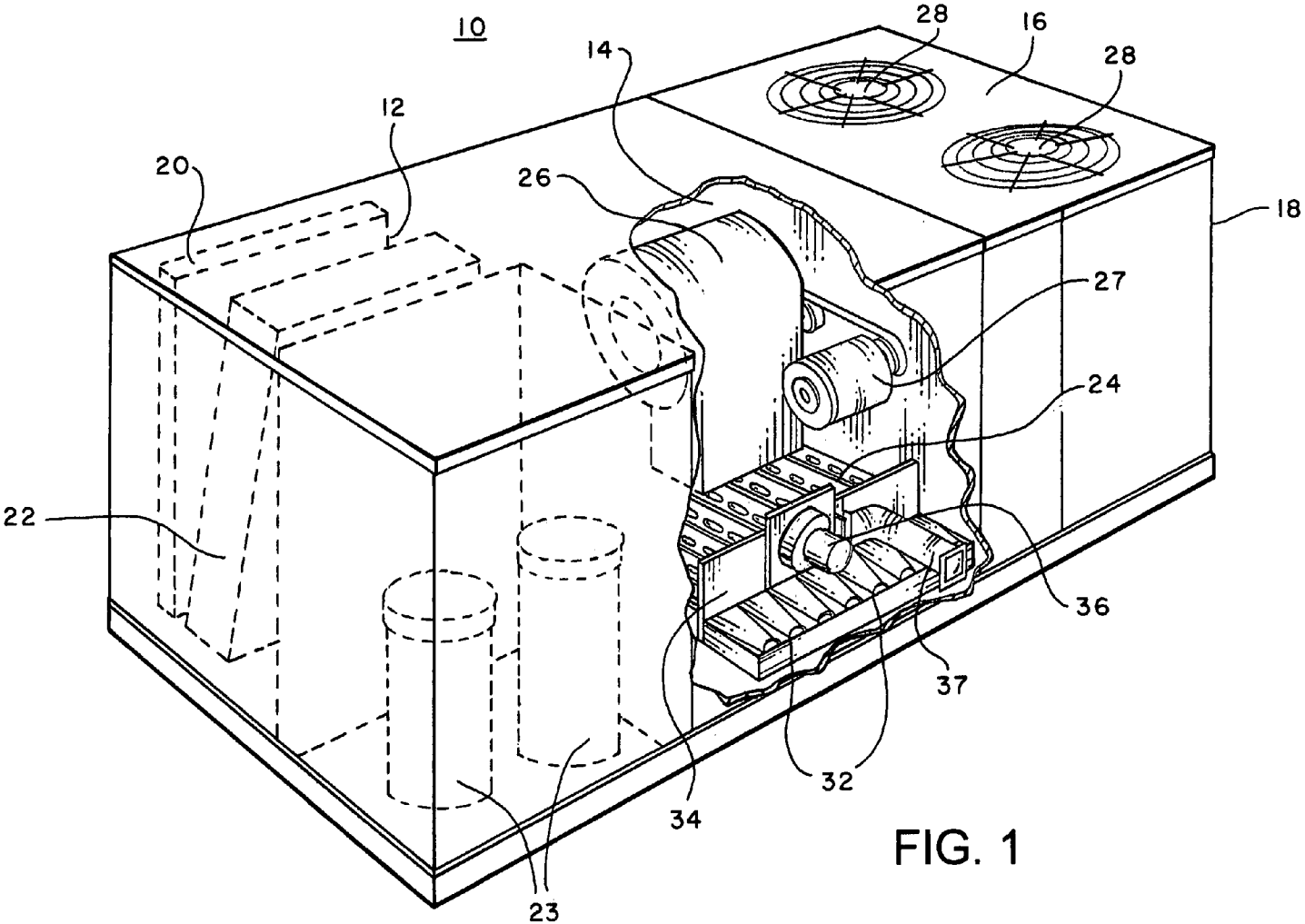
FIG. 1 is a general schematic view of a packaged air conditioning unit, comprised of a heating section, a cooling section and a condensing section.

Referring now to FIG. 1, a packaged gas heating/electric cooling unit 10 is depicted. Unit 10 includes cooling section 12, a heating section 14 and a condensing section 16, all of which are housed in a single metal cabinet 18. Cooling section 12 includes an air filter 20, an evaporator coil 22 and one or more compressors 23. Heating section 14 includes a heat exchanger 24 and a supply air blower 26, which is driven by an electric motor 27. Blower 26 sits above heat exchanger 24 and when operated blows air downwardly through heat exchanger 24. Condensing section 16 includes one or more condenser fans 28 and a condenser coil (not shown).

Figure 2:
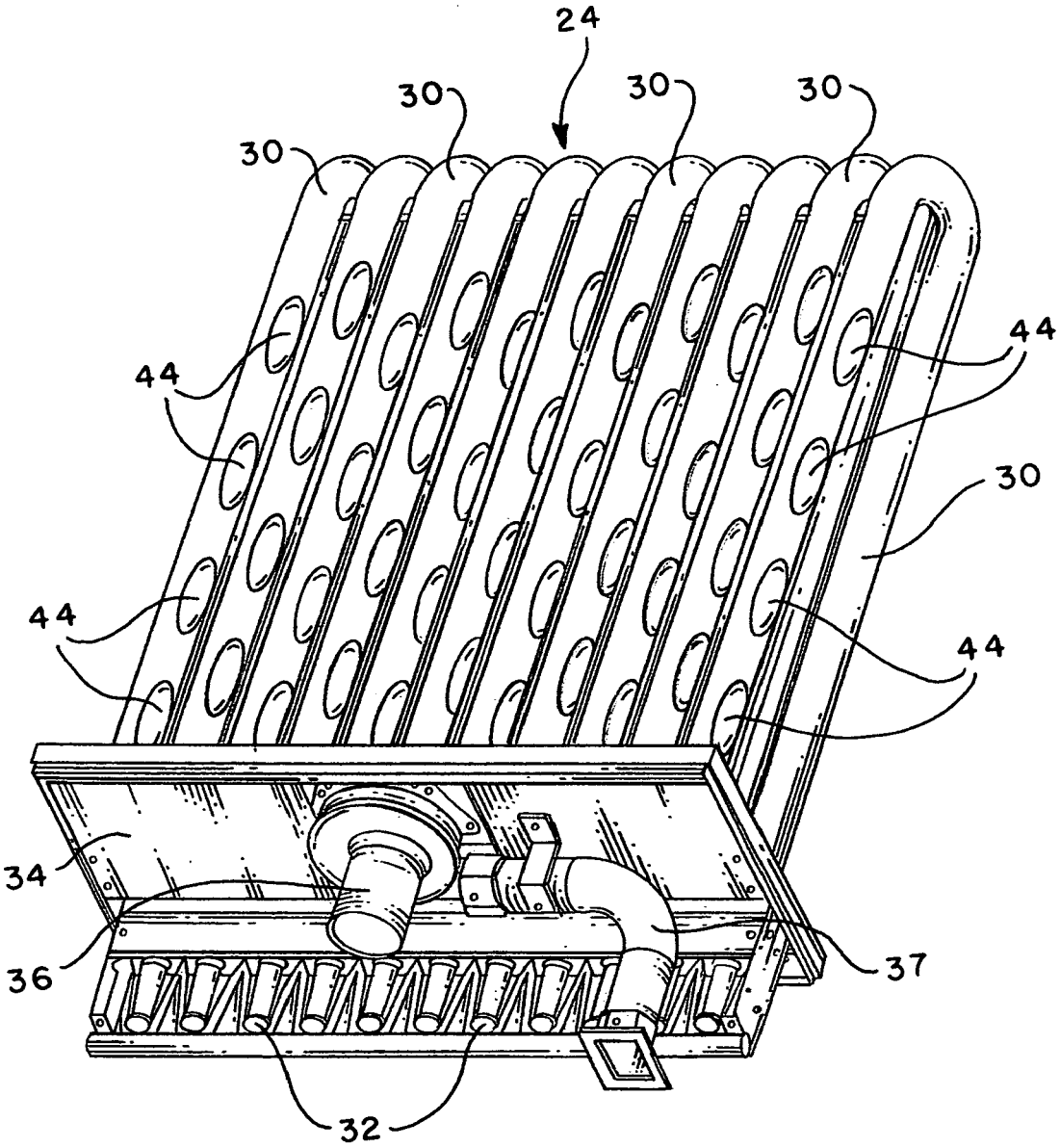
FIG. 2 is a perspective view of a heat exchanger according to the present invention, used in the heating section of the unit of FIG. 1.

Referring also to FIG. 2, heat exchanger 24 has plural tubes 30 bent-in a U-shaped configuration. An inlet end of each tube 30 communicates with one of a plurality of burners 32 and an outlet end of each tube 30 communicates with a header box 34 wherein flue products are collected after passing through tubes 30. An induced draft blower 36 communicates with header box 34 for exhausting flue products from heat exchanger 24 to the atmosphere via a conduit 37 in the conventional manner.

When unit 10 is operated in a heating mode, burners 32 burn a combustible fuel-air mixture and the combustion products are drawn through tubes 30 by induced draft blower 36. Supply air blower 26 draws the air to be heated from a return duct (not shown) into unit 10 through filter 20 to remove dirt and other debris therefrom and blows the air across heat exchanger tubes 30, whereby heat is transferred through the tube walls from the flue products inside tubes 30 to the air flowing across the outside of heat exchanger 24. Blower 26 blows the heated air from unit 10 into a supply duct (not shown), which communicates with an indoor space to be heated. Evaporator coil 22, condenser fans 28 and the condenser coil are inoperative in the heating mode.

When unit 10 is operated in a cooling mode, heat exchanger 24, burners 32 and induced draft blower 36 are inoperative. A vapor compression refrigerant is circulated by one or more of the compressors 23 between evaporator coil 22 and the condenser coil in the conventional manner. The refrigerant is vaporized in evaporator coil 22, which transfers heat from air drawn through coil 22 by supply air blower 26 to the refrigerant, thereby cooling the air. The cooled air is then blown through heating section-14 into the supply duct, which conducts the heated air to the indoor space.

Figure 3:
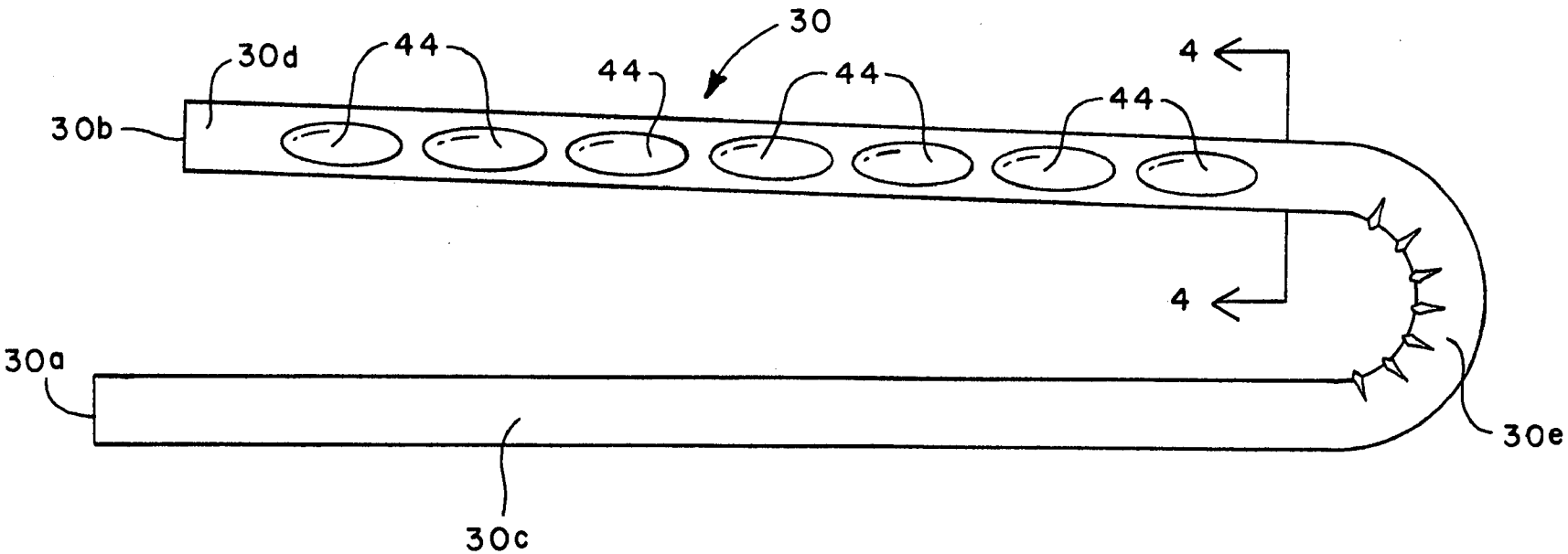
FIG. 3 is a side elevation view of one of the tubes in the heat exchanger of FIG. 2.

Referring now to FIGS. 2 and 3, each tube 30 preferably has a circular cross-section with an outer diameter of about 2 inches. Tubes 30 are preferably made of a relatively thin wall of corrosive resistant metal material, such as aluminized steel, which circumscribes a hollow interior through which the flue products from burners 32 flow in the heating mode. Each tube 30 has an inlet end 30*a* in communication with one of the burners 32 and an outlet end 30*b* in communication with the header box 34. The U-shaped configuration of tubes 30 causes the flue products in each tube 30 to make two passes through heat exchanger-24. As can be best seen in FIG. 3, each tube 30 includes first and second leg portions 30*c*, 30*d* and a return bend portion 30*e*. Leg portion 30*c* communicates with a corresponding one of burners 32 and therefore represents an "upstream" leg of tube 30, which corresponds to the first pass of the flue products through tube 30. Leg portion 30*d* communicates with header box 34 and therefore represents a "downstream" leg of tube 30, which corresponds to the second pass of the flue products through tube 30.

Each tube 30 has plural cooperating pairs of dimples 44 formed in the "downstream" leg 30*d* thereof, at predetermined intervals (e.g., 4.25 inches) along leg 30*d*. The "upstream" leg 30*c* of the tube 30, which corresponds to the first pass of the flue gas through tube 30 between inlet end 30*a* and return bend portion 30*e*, has a relatively smooth wall. As can be best seen in FIG. 5, the two dimples 44*a*, 44*b* of each cooperating pair are in generally diametrically opposed relationship, but are offset from each other along a longitudinal axis of leg 30*d*. In the preferred embodiment, the amount of offset between any cooperating pair of dimples 44 does not exceed one-half of the dimple length along the longitudinal axis of leg 30*d*.

Figure 5:
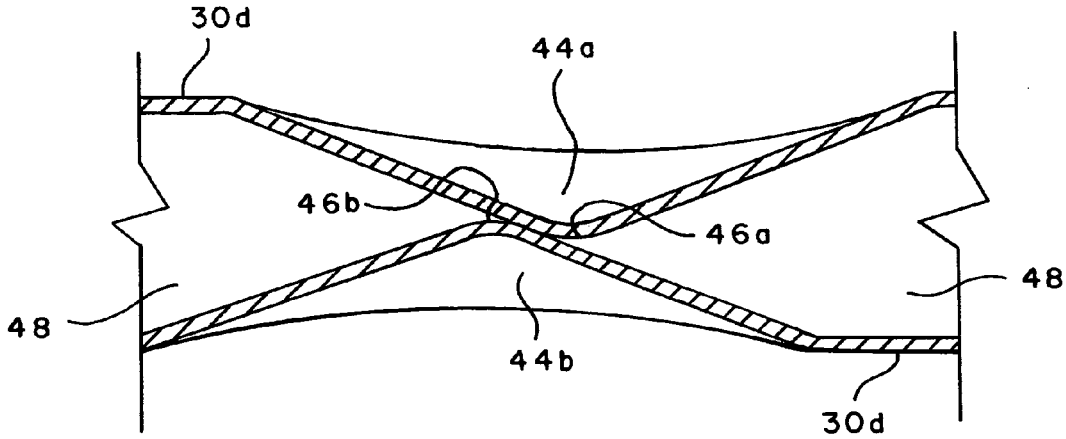
FIG. 5 is a sectional view, taken along the line 5—5 of FIG. 4.

Each dimple 44 defines a generally convex protrusion into an interior passageway 48. Dimples 44 preferably extend inwardly beyond a central longitudinal axis of passageway 48, so that the dimples 44 of each cooperating pair may be in at least partial contact, as best seen in FIG. 5. For example, if tube 30 has an outer diameter of 2 inches, each dimple 44 may protrude approximately 1.03 inch into passageway 48. Contact between the dimples 44 of each cooperating pair causes the flue gases to change directions and slows down their flow in passageway 48, thereby increasing turbulence and enhancing heat transfer.

Figure 4:
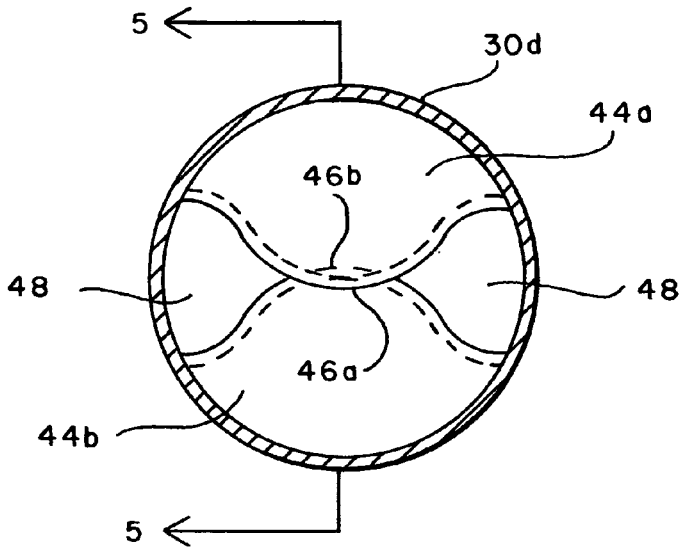
FIG. 4 is a sectional view, taken along the line 4—4 of FIG. 3.

Dimples 44 preferably are punched into the wall of downstream leg 30*c* of each tube 30 on the sides thereof so that there are no constrictions in the bottoms of tubes 30 to interfere with drainage of condensate therefrom. Specifically, each dimple 44 is preferably formed by deforming the tube wall inwardly by means of a spherical punching tool (not shown). The result of the punching process is a generally elliptical, concave indentation in the tube wall on the outside of the corresponding tube 30, as can be best seen in FIG. 3, and a corresponding generally elliptical, convex protrusion inside the corresponding tube 30, as can be best seen in FIGS. 4 and 5.

The best mode for carrying out the invention has now been described in detail. Since changes in and additions to the above-described best mode can be made without departing from the nature, spirit and scope of the invention, the invention is not to be limited to the above-described best mode, but only by the appended claims and their equivalents.

What is claimed is:

1. In a heat exchanger having a tube with an interior passageway and a wall surrounding said passageway, wherein the improvement comprises a pair of generally opposed dimples projecting from said wall into said passageway, said dimples being offset from each other in a direction parallel to a longitudinal axis of said tube such that only a portion of each dimple is aligned with the other dimple along an axis transverse to said longitudinal axis, at least one dimple projecting into said passageway a distance greater than one-half of a minor dimension of said tube, said minor dimension being measured along said axis transverse to said longitudinal axis.

2. The heat exchanger of claim 1 further including a plurality of pairs of dimples projecting from said wall into said passageway at respective selected locations along said tube, the dimples of each pair being in generally opposed relationship, but being offset from each other in a direction parallel to said longitudinal axis such that only a portion of each dimple is aligned with the other dimple of a corresponding pair along said axis transverse to said longitudinal axis.

3. The heat exchanger of claim 1 wherein each of said dimples defines a convex surface in said passageway.

4. The heat exchanger of claim 1 wherein each of said dimples has a major dimension and a minor dimension, said major dimension being parallel to said longitudinal axis, said dimples being offset from each other by an amount not greater than one-half of said major dimension.

5. The heat exchanger of claim 4 wherein said dimples project into said passageway a distance greater than one-half of a said minor dimension of said tube, such that respective portions of said dimples are in contact with each other within said passageway.

6. The heat exchanger of claim 1 wherein respective portions of said dimples are in contact with each other within said passageway.

7. The heat exchanger of claim 1 wherein said tube is generally U-shaped and has first and second leg portions with a return bend portion intermediate said first and second leg portions, said first leg portion extending between an inlet end of said tube and said return bend portion, said second leg portion extending between said return bend portion and an outlet end of said tube, said dimples being located in said second leg portion.

8. A heat exchanger tube of generally circular cross-section, said tube having an interior passageway, a wall surrounding said passageway and a pair of generally diametrically opposed dimples projecting from said wall into said passageway, said dimples being offset from each other along a length of said tube such that only a portion of each dimple is diametrically aligned with the other dimple, at least one of said dimples projecting into said passageway a distance greater than one-half of the diameter of said tube.

9. The tube of claim 8 further including a plurality of pairs of dimples projecting from said wall into said passageway at respective selected locations along said tube, the dimples of each pair being in generally diametrically opposed relationship, but being offset from each other such that only a portion of each dimple is diametrically aligned with the other dimple of a corresponding pair.

10. The tube of claim 8 wherein each of said dimples defines a convex surface in said passageway.

11. The tube of claim 8 wherein said dimples are offset from each other by an amount not greater than one-half of a length of each of said dimples parallel to a longitudinal axis of said tube.

12. The tube of claim 11 wherein said dimples project into said passageway a distance greater than one-half of the diameter of said tube such that respective portions of said dimples are in contact with one another in said passageway.

13. The tube of claim 8 wherein said dimples project into said passageway a distance greater than one-half of the diameter of said tube such that respective portions of said dimples are in contact with each other within said passageway.

14. The tube of claim 8 wherein said tube is generally U-shaped and has first and second leg portions and a return bend portion that is intermediate said first and second leg portions, said first leg portion extending between an inlet end of said tube and said return bend portion, said second leg portion extending between said return bend portion and an outlet end of said tube, said dimples being located in said second leg portion.

15. In a furnace having a heat exchanger with at least one generally cylindrical tube adapted to receive products of combustion, said at least one tube having an interior passageway and a wall surrounding said passageway, wherein the improvement comprises a pair of generally diametrically opposed dimples projecting from said wall into said passageway, said dimples being offset from each other along a length of said tube such that only a portion of each dimple is diametrically aligned with the other dimple, at least one dimple projecting into said passageway beyond a central longitudinal axis of said tube.

16. The furnace of claim 15 further including a plurality of cooperating pairs of dimples projecting from said at least one wall into said passageway at respective selected locations along said tube, the dimples of each cooperating pair being in generally diametrically opposed relationship, but being offset from each other along the length of said tube.

17. The furnace of claim 15 wherein both of the dimples of said pair project into said passageway beyond said central longitudinal axis.

18. The furnace of claim 15 wherein said dimples are offset from each other by an amount not greater than one-half of a length of each of said dimples along a longitudinal axis of said tube such that respective portions of said dimples are in contact with one another in said passageway.

19. The furnace of claim 17 wherein said dimples are offset from each other by an amount not greater than one-half of a length of each of said dimples in a direction parallel to said central longitudinal axis such that respective portions of said dimples are in contact with one another in said passageway.

* * * * *

UNITED STATES PATENT AND TRADEMARK OFFICE

CERTIFICATE OF CORRECTION

PATENT NO. : 6,945,320 B2
DATED : September 20, 2005
INVENTOR(S) : Havard et al.

It is certified that error appears in the above-identified patent and that said Letters Patent is hereby corrected as shown below:

Title page,
Item [75], Inventors, change the spelling of the first inventor's last name from "Harvard" to -- Havard --.

Signed and Sealed this

Fifteenth Day of November, 2005

JON W. DUDAS
*Director of the United States Patent and Trademark Office*